US010689919B2

(12) United States Patent
Drenth et al.

(10) Patent No.: US 10,689,919 B2
(45) **Date of Patent: *Jun. 23, 2020**

(54) SYSTEMS AND METHODS FOR RELEASING A PORTION OF A DRILL STRING FROM A DRILLED CABLE

(71) Applicant: BLY IP INC., Salt Lake City, UT (US)

(72) Inventors: Christopher L. Drenth, Burlington (CA); Anthony Lachance, Mississauga (CA); Michel Lauzon, Cochenour (CA)

(73) Assignee: BLY IP INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/296,991

(22) Filed: Mar. 8, 2019

(65) Prior Publication Data

US 2019/0203543 A1 Jul. 4, 2019

Related U.S. Application Data

(63) Continuation of application No. 15/378,966, filed on Dec. 14, 2016, now Pat. No. 10,253,575.

(Continued)

(51) Int. Cl.
*E21B 17/06* (2006.01)
*E21B 17/02* (2006.01)

(Continued)

(52) U.S. Cl.
CPC ..... *E21B 17/06* (2013.01); *E21B 17/023* (2013.01); *E21B 17/042* (2013.01); *E21B 17/05* (2013.01)

(58) Field of Classification Search
CPC ..... E21B 17/042; E21B 17/22; E21B 17/05; E21B 17/06; E21B 17/023; B66C 1/56; B66C 1/54; B25J 15/0047
See application file for complete search history.

(56) References Cited

U.S. PATENT DOCUMENTS 2,879,101 A * 3/1959 Daroci ..... B25B 27/02 254/29 R
3,006,680 A * 10/1961 Gregory ..... E21B 19/00 138/90

(Continued)

FOREIGN PATENT DOCUMENTS

WO WO-2012/119186 A1 9/2012
WO WO-2014/131614 A2 9/2014

(Continued)

OTHER PUBLICATIONS

International Search Report and Written Opinion dated Apr. 20, 2017 by the International Searching Authority for International Application No. PCT/US2016/066608, filed on Dec. 14, 2016 and published as WO 2017/106311 on Jun. 22, 2017 (Applicant—BLY IP INC.) (9 Pages).

(Continued)

*Primary Examiner* — Stephen A Vu
(74) *Attorney, Agent, or Firm* — Ballard Spahr LLP

(57) ABSTRACT

A cable release system for permitting detachment of a drilling cable from a drill string. The cable release system has a swivel body, a bearing assembly, one or more locking elements, and a release sleeve assembly. The swivel body is coupled to a drilling cable. The bearing assembly has a receptacle body that receives a portion of the swivel body and defines openings that receive a portion of corresponding locking elements. The bearing assembly has an outer sleeve that circumferentially surrounds the receptacle body and has a variable inner diameter such that axial movement of outer sleeve controls the radial position of the locking elements relative to the swivel body. The release sleeve assembly can be moved in a distal direction to engage the outer sleeve of the bearing assembly to move the outer sleeve to an axial (Continued)

position in which the swivel body and drilling cable are detachable from the remainder of the drill string.

20 Claims, 10 Drawing Sheets

Related U.S. Application Data

(60) Provisional application No. 62/266,804, filed on Dec. 14, 2015.

(51) Int. Cl.
*E21B 17/042* (2006.01)
*E21B 17/05* (2006.01)

(56) References Cited

U.S. PATENT DOCUMENTS

| | | | | |
|---|---|---|---|---|
| 3,033,605 | A * | 5/1962 | Morrow, Jr. ..... | B29D 30/0016 294/115 |
| 3,537,743 | A | 11/1970 | Martinsen | |
| 4,834,198 | A | 5/1989 | Thompson | |
| 6,997,493 | B2 * | 2/2006 | Beach ..... | E21B 31/18 294/86.27 |
| 10,253,575 | B2 * | 4/2019 | Drenth ..... | E21B 17/042 |
| 2004/0134667 | A1 | 7/2004 | Brewer et al. | |
| 2008/0236841 | A1 | 10/2008 | Howlett et al. | |
| 2011/0174500 | A1 | 7/2011 | Davies et al. | |
| 2017/0051571 | A1 | 2/2017 | Drenth et al. | |
| 2017/0167204 | A1 | 6/2017 | Drenth et al. | |

FOREIGN PATENT DOCUMENTS

| | | | |
|---|---|---|---|
| WO | WO-2015/103027 | A1 | 7/2015 |
| WO | WO-2017/106311 | A1 | 6/2017 |

OTHER PUBLICATIONS

International Preliminary Report on Patentability dated Jun. 19, 2018 by the International Searching Authority for International Application No. PCT/US2016/066608, filed on Dec. 14, 2016 and published as WO 2017/106311 on Jun. 22, 2017 (Applicant—BLY IP INC.) (5 Pages).

Substantive Report dated Mar. 19, 2019 by the Chilean Patent Office for CL Application No. 201801588, filed on Dec. 14, 2016 and published as CL 2018001588 A1 on Aug. 17, 2018 (Applicant—BLY IP INC.) (17 Pages).

Non Final Rejection dated Aug. 2, 2018 by the USPTO for U.S. Appl. No. 15/378,966, filed Dec. 14, 2016 and granted as U.S. Pat. No. 10,253,575 on Apr. 9, 2019 (Inventor—Christopher L. Drenth) (6 Pages).

Reponse to Non Final Rejection dated Nov. 2, 2018 to the USPTO for U.S. Appl. No. 15/378,966, filed Dec. 14, 2016 and granted as U.S. Pat. No. 10,253,575 on Apr. 9, 2019 (Inventor—Christopher L. Drenth) (13 Pages).

Notice of Allowance dated Dec. 10, 2018 by the USPTO for U.S. Appl. No. 15/378,966, filed Dec. 14, 2016 and granted as U.S. Pat. No. 10,253,575 on Apr. 9, 2019 (Inventor—Christopher L. Drenth) (7 Pages).

Amendment After Notice of Allowance dated Mar. 8, 2019 to the USPTO for U.S. Appl. No. 15/378,966, filed Dec. 14, 2016 and granted as U.S. Pat. No. 10,253,575 on Apr. 9, 2019 (Inventor—Christopher L. Drenth) (4 Pages).

Issue Notification dated Mar. 20, 2019 by the USPTO for U.S. Appl. No. 15/378,966, filed Dec. 14, 2016 and granted as U.S. Pat. No. 10,253,575 on Apr. 9, 2019 (Inventor—Christopher L. Drenth) (1 Page).

European Search Report and Written Opinion dated Jul. 4, 2019 by the European Patent Office for EP Application No. 16876560.0, filed on Dec. 14, 2016 and published as 3390764 on Oct. 24, 2018 (Applicant—BLY IP, INC.) (6 Pages).

* cited by examiner

SYSTEMS AND METHODS FOR RELEASING A PORTION OF A DRILL STRING FROM A DRILLED CABLE

CROSS-REFERENCE TO RELATED APPLICATION

This application is a continuation of U.S. application Ser. No. 15/378,966, filed Dec. 14, 2016, which claims priority to, and the benefit of, the filing date of U.S. Provisional Application No. 62/266,804, filed Dec. 14, 2015, which applications are hereby incorporated herein by reference in its entirety.

FIELD

The disclosed invention relates to assemblies, systems, and methods for releasing a portion of a drill string from a drilling cable, such as, for example, a wireline cable.

BACKGROUND

During wireline drilling operations, it is common for portions of the drill string to get stuck underground. Typically, when this happens, it is desirable to disconnect the wireline cable from the drill string, thereby releasing the drill string from the wireline cable. However, known systems and methods disconnecting the wireline cable from the drill string under these conditions are ineffective, unreliable, and/or excessively expensive.

Thus, there is a need for systems and methods that address one or more of the deficiencies of known systems and methods for disconnecting drilling cables from portions of a drill string.

SUMMARY

Described herein, in various aspects, is a cable release system. The cable release system can have a swivel body, a bearing assembly, a plurality of locking elements, and a release sleeve assembly. The swivel body can be configured for coupling to a drilling cable and can have a distal end portion having an outer surface and defining at least one groove that is radially recessed relative to the outer surface. The bearing assembly can have a receptacle body and an outer sleeve. The receptacle body can have a wall with an outer surface. The wall can have a proximal portion that defines an interior cavity configured to receive at least a portion of the distal end portion of the swivel body. The outer sleeve can have a wall that at least partially circumferentially surrounds the wall of the receptacle body. The wall of the outer sleeve can have an inner surface that is radially spaced from the outer surface of the wall of the receptacle body. The plurality of locking elements can be positioned in engagement with the inner surface of the outer sleeve. The release sleeve assembly can be axially moveable relative to a drilling axis. Upon movement of the release sleeve assembly in a distal direction relative to the drilling axis, the release sleeve assembly can be configured to engage the outer sleeve of the bearing assembly to effect distal movement of the outer sleeve relative to the drilling axis from a first axial position to a second axial position. Distal movement of the outer sleeve of the bearing assembly from the first axial position to the second axial position can effect radial movement of the plurality of locking elements from a retracted position in which the locking elements are received within the at least one groove of the distal end portion of the swivel body to an extended position in which the locking elements are disengaged from the outer surface of the distal end portion of the swivel body.

Also described is a cable release assembly having a swivel body, a bearing assembly, and a plurality of locking elements. The swivel body can be configured for coupling to a drilling cable and have a distal end portion having an outer surface and defining at least one groove that is radially recessed relative to the outer surface. The bearing assembly can have a receptacle body and an outer sleeve. The receptacle body can have a wall with an outer surface. The wall can have a proximal portion that defines an interior cavity configured to receive at least a portion of the distal end portion of the swivel body. The outer sleeve can have a wall at least partially circumferentially surrounding the wall of the receptacle body. The wall of the outer sleeve can have an inner surface that is radially spaced from the outer surface of the wall of the receptacle body. The plurality of locking elements can be positioned in engagement with the inner surface of the outer sleeve. Distal movement of the outer sleeve of the bearing assembly from a first axial position to a second axial position can effect radial movement of the plurality of locking elements from a retracted position in which the locking elements are received within the at least one groove of the distal end portion of the swivel body to an extended position in which the locking elements are disengaged from the outer surface of the distal end portion of the swivel body.

Further described herein is release sleeve assembly having a thimble body and a release sleeve. The thimble body can have a proximal end portion, an opposed distal end portion, and a central bore extending through the proximal and distal end portions. The distal end portion can define a groove. The central bore of the thimble body can be configured to receive a portion of a drilling cable. The release sleeve can have a proximal end, an opposed distal end, and a wall extending between the proximal and distal ends. The wall of the release sleeve can define a central bore of the release sleeve and an axial slit and a side opening positioned in communication with the central bore of the release sleeve. The axial slit can extend from the distal end of the release sleeve to the side opening. The side opening can extend from the axial slit to the proximal end of the release sleeve. The axial slit and the side opening of the release sleeve can be configured to receive a portion of a cable. The side opening of the release sleeve can be configured to receive a portion of the distal end portion of the thimble body. At least a portion of the wall of the release sleeve that defines the side opening can be configured for complementary engagement with the groove of the distal end portion of the thimble body. The axial slit and side opening of the release sleeve can be configured to permit engagement between the release sleeve and the distal end portion of the thimble body after a cable is positioned through the central bore of the thimble body.

DESCRIPTION OF THE DRAWINGS

FIG. 3A depicts the overshot system before the distal portion of the swivel body is received within the bearing assembly. FIG. 3B is a close-up view of the swivel body and the bearing assembly, following receipt of the distal portion of the swivel body within the bearing assembly. FIG. 3C depicts the overshot system after the distal portion of the swivel body is received within the bearing assembly.

FIG. 4A depicts the advancement of a first seal element relative to a thimble body as disclosed herein. FIG. 4B depicts the positioning of a second seal element over a drilling cable as disclosed herein. FIG. 4C depicts the positioning of a release sleeve over the drilling cable and the second seal element as disclosed herein. FIG. 4D depicts the assembled release sleeve assembly.

FIG. 5A depicts a conventional loading chamber assembly, whereas FIG. 5B is an isolated view of a slotted loading chamber body as disclosed herein.

DETAILED DESCRIPTION

Figure 1A:
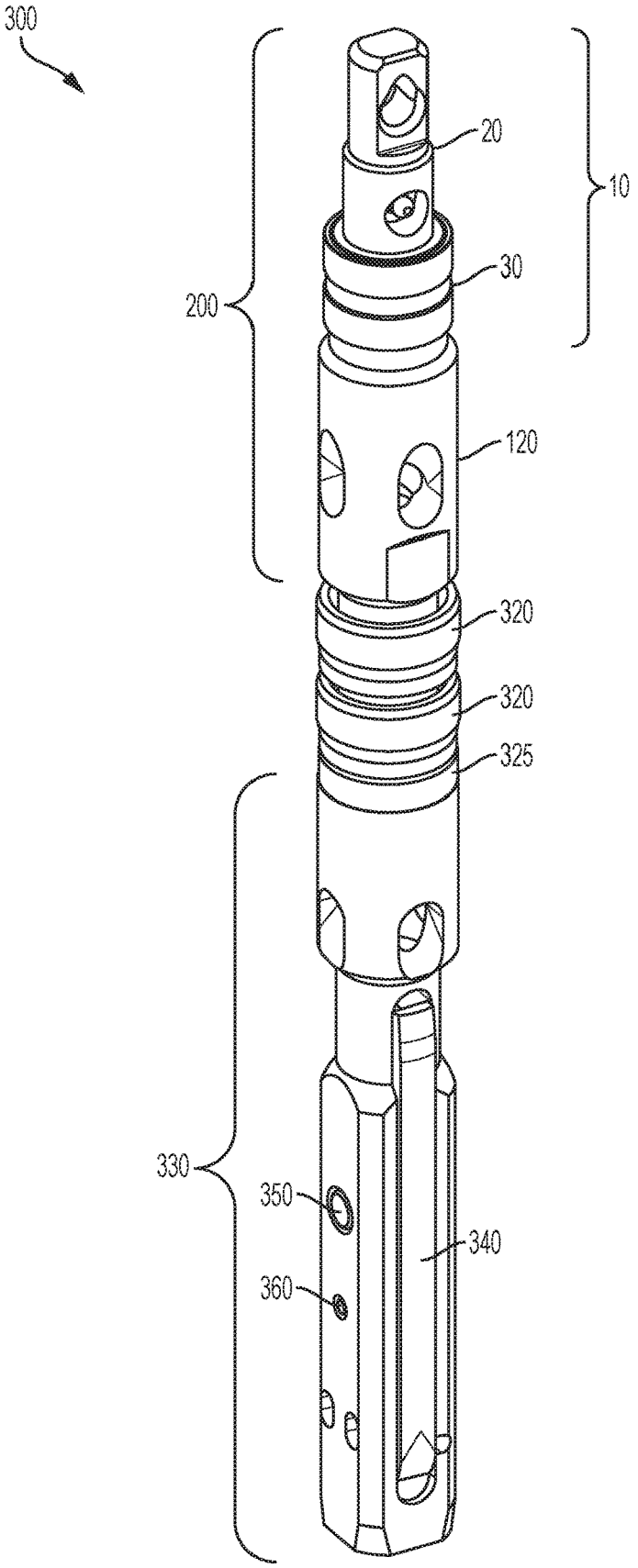
FIG. 1A is a perspective view of an overshot system comprising a cable release assembly and a biasing element as disclosed herein.
Figure 1B:
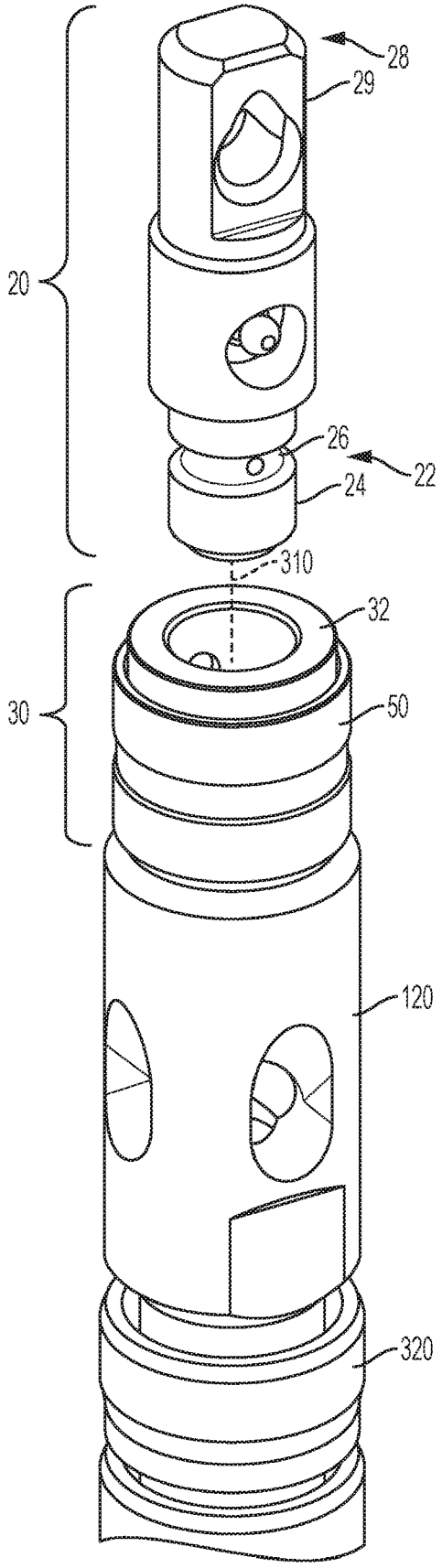
FIG. 1B is a close-up perspective view of the cable release assembly of the overshot system of FIG. 1A, with a spindle body of the cable release assembly separated from the bearing assembly.
Figure 1C:
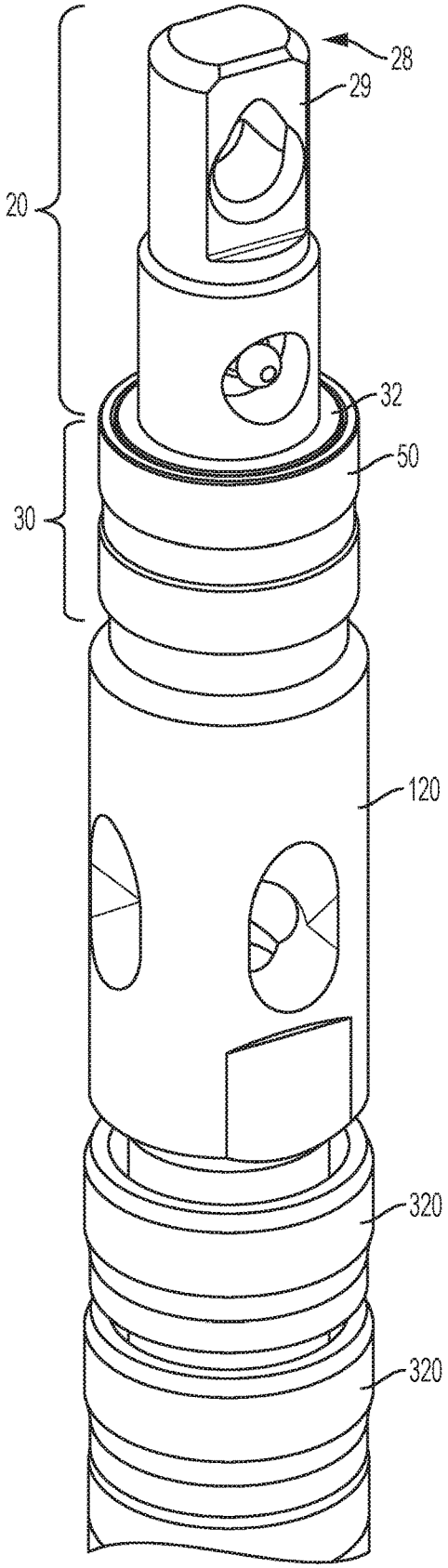
FIG. 1C is a close-up perspective view of the cable release assembly of the overshot system of FIG. 1A, with a distal portion of the spindle body of the cable release assembly received within the bearing assembly.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "an opening" can refer to one or more of such openings.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry.

Disclosed herein, in various aspects and with reference to FIGS. 1A-4D is a cable release system 200 comprising a cable release assembly 10 and a release sleeve assembly 70. In exemplary aspects, the cable release system 200 can be provided as part of an overshot system 300, such as, for example and without limitation, an overshot system that is used to retrieve an inner tube assembly from a formation during the course of wireline drilling operations. In these aspects, the overshot system 300 can comprise a drilling cable 305 that extends relative a drilling axis 310 within a formation (e.g., within a drill hole). It is contemplated that the overshot system 300 can further comprise conventional overshot components, including, for example and without limitation, sealing elements 320 (e.g., pump-in lip seals), a seal seat 325, and an overshot head assembly 330. In exemplary aspects, and as depicted in FIGS. 1A-1C and 3A-3C, the cable release system 200 can be secured to the overshot head assembly 330, such as, for example, via seal seat 325, which can be threadedly connected to a distal portion of the cable release system 200 and define a central bore as depicted in FIGS. 3A-3C (with the sealing elements 320 circumferentially surrounding an outer surface of the seal seat 325). In further exemplary aspects, the overshot head assembly 330 can comprise lifting dogs 340 that can be pivotally coupled to the body of the overshot head assembly 330 to permit gripping of the inner tube assembly. Optionally, the lifting dogs 340 can be pivotally coupled to the body of the overshot head assembly 330 using a pivot pin 350 and a spirol pin 360 as are known in the art. Exemplary, non-limiting overshot components are disclosed in U.S. Pat. No. 6,997,493, which is incorporated by reference herein in its entirety. However, it is contemplated that other overshot configurations can be used.

During conventional drilling, after an inner tube assembly is full of a sample, an overshot assembly is lowered (or pumped) toward the bottom of a drill hole to retrieve the inner tube assembly. Conventionally, the lifting dogs of the overshot head assembly securely grab a spearhead (spearpoint) that is coupled to the proximal end of the inner tube assembly. After engagement between the lifting dogs and the spearhead, the overshot is retrieved from the drill hole, and the sample is extracted from the inner tube assembly.

Optionally, in some exemplary aspects, it is contemplated that the disclosed cable release system 200 can be used with an overshot assembly as disclosed in U.S. patent application Ser. No. 15/240,142, entitled "Overshot Assembly and Systems and Methods of Using Same," which is incorporated by reference herein in its entirety. Thus, in these aspects, it is contemplated that the overshot system can comprise an overshot assembly having a proximal body portion, a distal body portion, a spindle, and a latching assembly. The distal body portion can have a wall and a longitudinal axis. The wall of the distal body portion can have an inner surface, an outer surface, and a proximal end. The inner surface of the wall of the distal body portion can define a central bore of the distal body portion. The spindle can be at least partially received within the central bore of the distal body portion. The spindle can have an outer surface, a proximal portion, and a distal portion. The latching assembly can be operatively coupled to the distal body portion and configured for movement (e.g., radial movement) about and between a retracted position and a deployed position. The distal body portion can be configured for axial advancement relative to the spindle, and the spindle can be configured for axial movement but not rotational movement relative to the longitudinal axis of the distal body portion. In use, axial advancement of the distal body portion in a proximal direction relative to the spindle can be configured to effect movement of the latching assembly from its deployed position toward its retracted position. In other optional aspects, it is contemplated that the overshot system can comprise an overshot assembly having a proximal body portion, a distal body portion, a sleeve subassembly, a spindle, a drive element and an engagement subassembly. The distal body portion can have a wall. The wall of the distal body portion can have an inner surface, an outer surface, and a proximal end, and the inner surface of the wall of the distal body portion can define a central bore of the distal body portion. The sleeve subassembly can define a central bore and have a common longitudinal axis with the distal body portion. The central bore of the sleeve subassembly can have proximal and distal portions. The sleeve subassembly can define a first seat within the central bore of the sleeve subassembly. The spindle can be at least partially received within the central bores of the sleeve subassembly and the distal body portion. The spindle can have an outer surface, a proximal portion, and a distal portion. The drive element can be secured to the proximal portion of the spindle. The engagement subassembly can be operatively coupled to the sleeve subassembly and project radially inwardly within the central bore of the sleeve subassembly. The sleeve subassembly can be configured for rotation about and between a locked position and an unlocked position. In the locked position, the drive element can abut the first seat defined by the sleeve subassembly. In the unlocked position, the sleeve subassembly can be configured for axial advancement relative to the spindle, and the drive element and the spindle can be configured for receipt within the distal portion of the central bore of the sleeve subassembly. Optionally, the overshot assembly can comprise a latching assembly operatively coupled to the distal body portion and configured for movement (e.g., radial movement) about and between a retracted position and a deployed position. Axial advancement of the distal body portion and the sleeve subassembly relative to the spindle can be configured to effect movement of the latching assembly from its deployed position toward its retracted position. Optionally, the overshot assembly can comprise a locking assembly operatively coupled to the distal body portion and configured for movement about and between a retracted position and a deployed position. When the sleeve subassembly is positioned in the unlocked position, the locking assembly can be moved from its deployed position toward its retracted position to drive axial advancement of the sleeve subassembly relative to the spindle.

The Cable Release Assembly

In exemplary aspects, and with reference to FIGS. 1A-1C and 3A-3C, the cable release assembly 10 can comprise a swivel body 20, a bearing assembly 30, and a plurality of locking elements 60. In one aspect, the swivel body 20 can be configured for coupling to the drilling cable 305 and can have a distal end portion 22. In this aspect, the distal end portion 22 can have an outer surface 24 and define at least one groove 26 that is radially recessed relative to the outer surface. It is contemplated that the swivel body 20 can further comprise a proximal end portion 28 that defines an eyebolt 29 for coupling to the drilling cable in a conventional manner. In use, the swivel body 20 can be configured to prevent the drilling cable 305 from twisting or failing. Optionally, in exemplary aspects, the swivel body 20 can comprise a grease fitting 25 as is known the art. In these aspects, the grease fitting 25 can be positioned in fluid communication with the outer surface 24 of the distal end portion 22 of the swivel body 20 via at least one channel defined within the swivel body. Optionally, in these aspects, the grease fitting 25 can be positioned within a recessed portion 27 of the swivel body 20 located between the proximal and distal end portions 28, 22 of the swivel body.

Figure 3A:
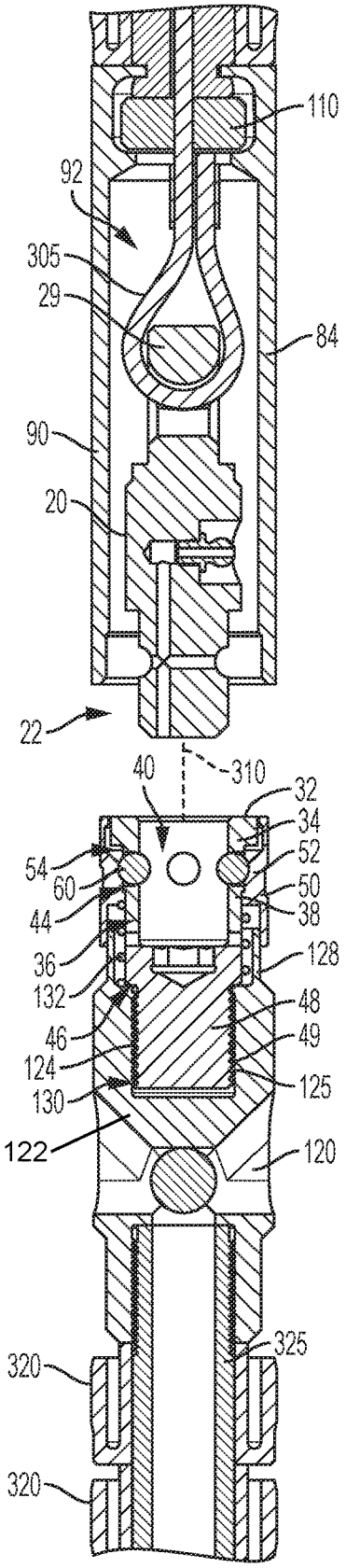
FIGS. 3A-3C are side cross-sectional views of an overshot system as disclosed herein, showing the movement of an exemplary swivel body and release sleeve assembly relative to a bearing assembly as disclosed herein.
Figure 3B:
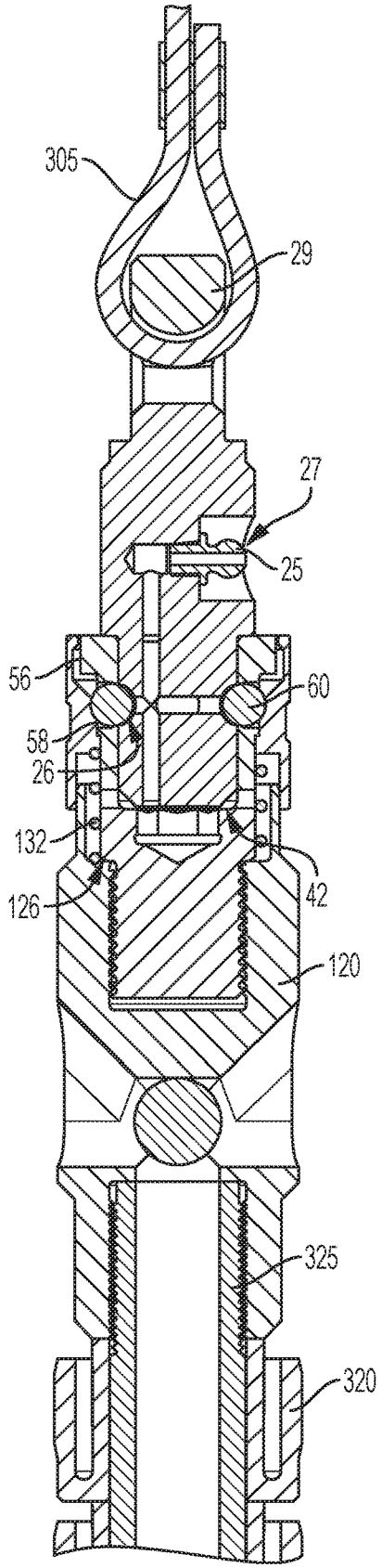
Figure 3C:
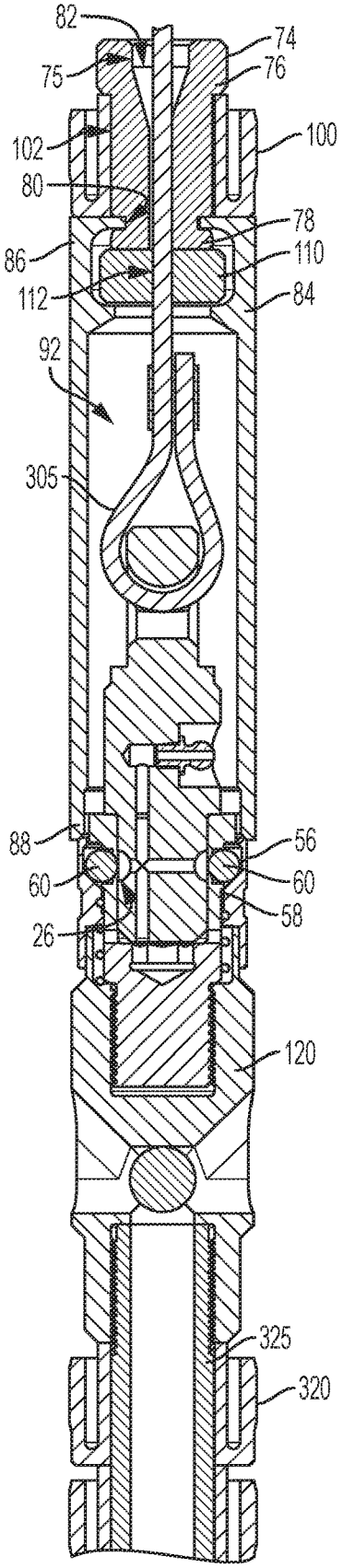

In another aspect, and as shown in FIGS. 3A-3C, the bearing assembly 30 can comprise a receptacle body 32 having a wall 34 with an outer surface 36. In this aspect, the wall 34 can have a proximal portion 38 that has an inner surface that defines an interior cavity 40 configured to receive at least a portion of the distal end portion 22 of the swivel body 20. In an additional aspect, the bearing assembly 30 can comprise an outer sleeve 50 having a wall 52 at least partially circumferentially surrounding the wall 34 of the receptacle body 32. In this aspect, the wall 52 of the outer sleeve 50 can have an inner surface 54 that is radially spaced from the outer surface 36 of the wall 34 of the receptacle body 32.

In a further aspect, at least one locking element 60 can be positioned in engagement with the inner surface 54 of the outer sleeve 50. In exemplary aspects, it is contemplated that each locking element can comprise a plurality of balls or other rounded elements. However, it is further contemplated that the at least one locking element 60 can comprise at least one of a roller, a cylinder, a cam-shaped element, and the like. Optionally, the locking elements 60 can comprise stainless steel. However, it is contemplated that any suitable material can be used. In exemplary aspects, the at least one locking element 60 can comprise a plurality of locking elements. In these aspects, it is contemplated that the plurality of locking elements can be equally or substantially equally circumferentially spaced about the receptacle body 32.

In another aspect, and with reference to FIGS. 3A-3C, the release sleeve assembly 70 can be axially moveable relative to the drilling axis 310, for example by conventional pumping operations, such as pump-in hydraulic (fluid) pressure. In this aspect, upon movement of the release sleeve assembly 70 in a distal direction relative to the drilling axis 310, the release sleeve assembly can be configured to engage the outer sleeve 50 of the bearing assembly 30 to effect distal movement of the outer sleeve relative to the drilling axis from a first axial position to a second axial position. It is contemplated that distal movement of the outer sleeve 50 of the bearing assembly 30 from the first axial position to the second axial position can effect radial movement of the plurality of locking elements 60 from a retracted position in which the locking elements are received within the at least one groove 26 of the distal end portion 22 of the swivel body 20 to an extended position in which the locking elements are disengaged from (and positioned radially outwardly of) the outer surface 24 of the distal end portion 22 of the swivel body 20. Thus, following disengagement of the locking elements 60 from the distal end portion 22 of the swivel body 20, the swivel body and the release sleeve assembly 70 can be separated from the remainder of the overshot system 300 and retracted from the formation.

In another aspect, the wall 34 of the receptacle body 32 can define a plurality of radial openings 44 extending from the inner surface 39 to the outer surface 36 of the proximal portion 38 of the receptacle body 32. In this aspect, each respective radial opening 44 of the receptacle body 32 can be configured to receive a portion of a corresponding locking element 60 and permit radial movement of the locking element about and between the retracted position and the extended position.

In a further aspect, and as shown in FIGS. 3A-3C, the inner surface 54 of the wall 52 of the outer sleeve 50 can have a first portion 56 having a first radial thickness and a second portion 58 having a second radial thickness less than the first radial thickness. In this aspect, in the first axial position, the second portion 58 of the inner surface 54 of the outer sleeve 50 can drive the locking elements to the retracted position. It is contemplated that, as the outer sleeve 50 moves from the first axial position to the second axial position (and the second portion 58 of the inner surface 54 no longer drives the locking elements 60 to the retracted position), the plurality of locking elements can move into the extended position and be disengaged from the outer surface 24 of the distal end portion 22 of the swivel body 20.

In an additional aspect, the interior cavity 40 of the receptacle body 32 can have a base surface 42 that is configured for engagement with the distal end portion 22 of the swivel body 20. In another aspect, the receptacle body 32 can have a distal portion 48 that extends axially away from the base surface 42 of the interior cavity 40.

Figure 2:
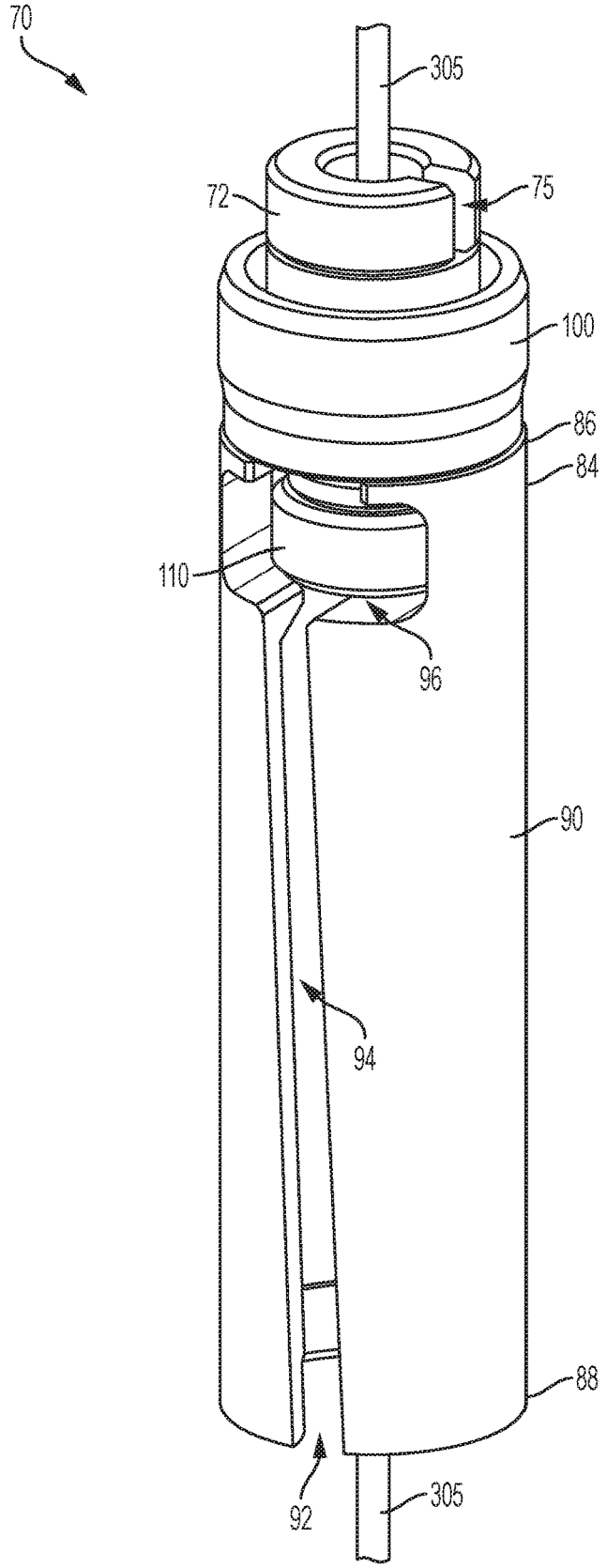
FIG. 2 is a perspective view of an exemplary release sleeve assembly as disclosed herein.

In another aspect, and with reference to FIGS. 2-3C, the cable release system 200 can further comprise a biasing element 120 configured to axially bias the outer sleeve 50 in a proximal direction. In this aspect, it is contemplated that the biasing element 120 can serve as an overshot upper body. Optionally, in exemplary aspects, the biasing element 120 can comprise a distal body 122 and a spring 132. In these aspects, the distal body 122 can at least partially circumferentially surround the distal portion 48 of the receptacle body 32 and be positioned in engagement with (or be coupled or secured to) the distal portion of the receptacle body. It is contemplated that the distal body 122 can have an interior surface 124 that defines a seat 126. In another aspect, the spring 132 can be positioned between and in engagement with the seat 126 of the distal body 122 and a portion of the outer sleeve 50. In this aspect, it is contemplated that the spring 132 can circumferentially surround at least a portion of the proximal portion 38 of the receptacle body 32. In a further aspect, the distal body 122 can have a proximal end portion 128 that defines an interior cavity 130 that receives at least a portion of the spring 132 and at least a portion of the proximal end portion 38 of the receptacle body 32. In this aspect, the outer sleeve 50 can at least partially circumferentially surround at least a portion of the proximal end portion 128 of the distal body 122. In exemplary aspects, as shown in FIGS. 3A-3C, a distal portion of the distal body 122 can define a threaded opening configured to receive and threadingly engage a portion of an overshot head assembly, such as a spindle of a seal seat 325 as further disclosed herein.

In additional aspects, at least a portion 49 of the distal portion 48 of the receptacle body 32 can be threaded. In these aspects, it is contemplated that the interior surface 124 of the distal body 122 can have a threaded portion 125 that is configured for threaded engagement with the threaded portion 49 of the distal portion 48 of the receptacle body 32.

In further aspects, the proximal portion 38 of the receptacle body 32 can define a shoulder surface 46 that extends radially outwardly from the distal portion 48 of the receptacle body. In these aspects, the seat 126 of the distal body 122 can be configured to abut the shoulder surface 46 of the proximal portion 38 of the receptacle body 32.

The Release Sleeve Assembly

In exemplary aspects, and with reference to FIGS. 2-4D, the release sleeve assembly 70 can comprise a thimble body 72 and a release sleeve 84. Optionally, in one aspect, the thimble body 72 can have a proximal end portion 74, an opposed distal end portion 78, and a central bore 82 extending through the proximal and distal end portions. In another aspect, the distal end portion 78 of the thimble body 72 can define a groove 80. In a further aspect, the central bore 82 of the thimble body 72 can be configured to receive a portion of the drilling cable 305. In this aspect, it is contemplated that the thimble body 72 can comprise an axial slit 75 that extends along the axial length of the thimble body and is positioned in communication with the central bore 82 to permit positioning of the drilling cable 305 within the central bore.

Optionally, in other exemplary aspects, the release sleeve 84 can have a proximal end 86, an opposed distal end 88, and a wall 90 extending between the proximal and distal ends. In these aspects, the wall 90 of the release sleeve 84 can define a central bore 92 of the release sleeve and an axial slit 94 and a side opening 96 positioned in communication with the central bore of the release sleeve. In further aspects, the axial slit 94 can extend from the distal end 88 of the release sleeve 84 to the side opening 96, and the side opening can extend from the axial slit to the proximal end 86 of the release sleeve. In use, the axial slit 94 and the side opening 96 of the release sleeve 84 can be configured to receive a portion of the drilling cable 305, and the side opening of the release sleeve can be configured to receive a portion of the distal end portion 78 of the thimble body 72. In exemplary aspects, at least a portion of the wall 90 of the release sleeve 84 that defines the side opening 96 can be configured for complementary engagement with the groove 80 of the distal end portion 78 of the thimble body 72. In further exemplary aspects, the axial slit 94 and side opening 96 of the release sleeve 84 can be configured to permit engagement between the release sleeve and the distal end portion 78 of the thimble body 72 after a drilling cable 305 is positioned through the central bore 82 of the thimble body 72.

In exemplary aspects, the release sleeve assembly 70 can further comprise a first seal element 100 that defines a central bore 102. Optionally, in use, it is contemplated that the first seal element 100 can be configured for positioning between the proximal end 86 of the release sleeve 84 and the proximal flange 76 of the thimble body 72 such that the central bore 102 of the first seal element receives a portion of the thimble body. Optionally, in various aspects, the first seal element 100 can be a lip seal as is known in the art. In exemplary aspects, the first seal element 100 can comprise at least one of rubber and polyurethane. However, it is contemplated that any suitable sealing material can be used. In use, it is contemplated that the first seal element 100 can be configured to form a seal around the outer surface of the thimble body as shown in FIGS. 2 and 4A-4D.

In further exemplary aspects, the release sleeve assembly 70 can further comprise a second seal element 110 that defines a central bore 112. In use, the second seal element 110 can be configured for positioning distal to the distal end portion 78 of the thimble body 72 such that the second seal element is positioned within the central bore 92 of the release sleeve 84. It is contemplated that the second seal element 110 can be configured to form a seal with a drilling cable 305 positioned within the central bore 92 of the release sleeve 84. In exemplary aspects, the first seal element 100 can comprise at least one of rubber and polyurethane. However, it is contemplated that any suitable sealing material can be used.

Figure 4C:
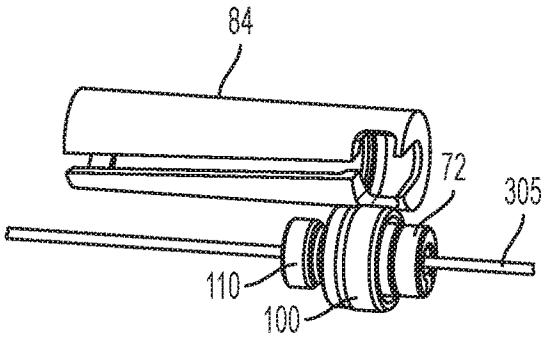
FIGS. 4A-4D are perspective views showing the sequential positioning of the components of an exemplary release sleeve assembly as disclosed herein.
Figure 4B:
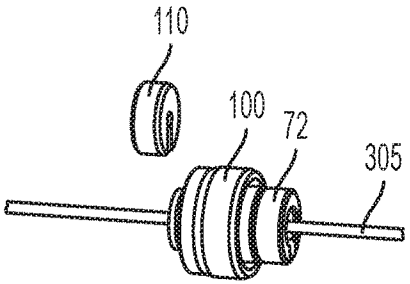
Figure 4A:
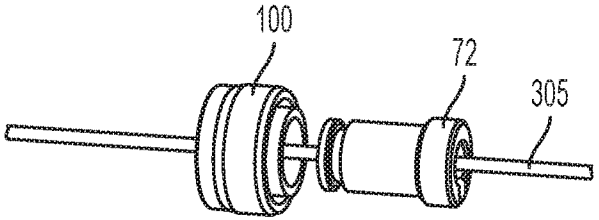

In use, and as depicted in FIGS. 4A-4D, it is contemplated that each component of the release sleeve assembly 70 can each be configured for positioning over a drilling cable 305. As shown in FIG. 4A, the thimble body 72 can be positioned over the drilling cable 305 by aligning the cable with the axial slit 75 and radially moving the thimble body 72 until the cable is received within the central bore 82 of the thimble body. In exemplary aspects, the first seal element can be positioned distal of the thimble body 72, and the thimble body can be advanced distally until the distal end portion 78 of the thimble body passes through the central bore 102 of the first seal. The second seal element 110 can then be positioned over the drilling cable 305 and advanced until it abuts the distal end portion 78 of the thimble body 72. Optionally, the second seal element 110 can be cut manually to form an appropriate slit that permits positioning of the seal element over the cable 305. Finally, the release sleeve 84 can be positioned over the drilling cable 305 by aligning the cable with the axial slit 94 and radially moving the release sleeve until the cable is received within the central bore 92 of the release sleeve. Following positioning of the release sleeve over the cable, the release sleeve and the thimble body can be moved relative to one another until the proximal end 86 of the release sleeve engages the groove 80 of the distal end portion 78 of the thimble body.

It is contemplated that the axial slit 94 of the release sleeve 84 can be wide enough to slip over the cable 305 but not oversized such that that the slit would promote accidental slipping off of the cable should the cable be off-center such as through a deviated portion of the drill string. Optionally, as shown in FIGS. 2 and 4A-4D, the axial slit 94 can be angled relative to the drilling axis 310 to reduce the possibility of parts slipping off the cable 305 should the cable be off-center.

Figure 4D:
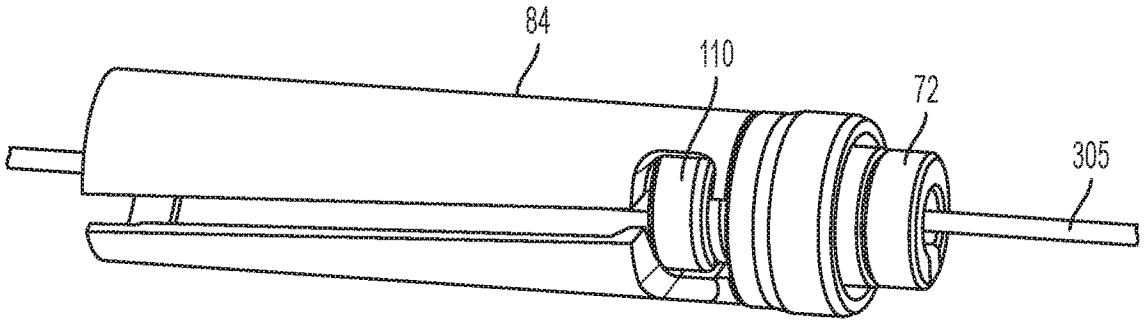

In still further exemplary aspects, the thimble body 72 and the release sleeve 84 can be held together without fasteners or threads. Optionally, in one aspect, it is contemplated that the proximal end portion 74 of the thimble body 72 can define a proximal flange 76. In this aspect, and as shown in FIG. 4D, the first seal element 100 can be axially secured (and at least partially received) between the proximal flange 76 of the thimble body and the proximal end 86 of the release sleeve.

As further disclosed herein, upon movement of the release sleeve assembly 70 in a distal direction relative to the drilling axis 310, the release sleeve assembly (e.g., the distal end 88 of the release sleeve 84) can be configured to engage the outer sleeve 50 of the bearing assembly 30 to effect distal movement of the outer sleeve relative to the drilling axis from a first axial position to a second axial position, thereby effecting radial movement of the locking elements 60 and disengaging the swivel body 20 from the remainder of the overshot system 300. With the swivel body 20 disengaged from the remainder of the overshot system, the drilling cable 305 (and the swivel body and release sleeve assembly 70) can be removed as further disclosed herein.

In operation, during removal of the drilling cable 305, it is contemplated that the distal portion of the cable can form a loop that contacts the second seal 110 and/or thimble body 72 as the cable is retracted in a proximal direction, thereby driving the release sleeve assembly 70 in a proximal direction so that the swivel body 20 and the release sleeve assembly 70 can be removed from the formation as an integrated unit.

Thus, in use, it is contemplated that the disclosed components can function together as a reliable cable release system, which is a huge advantage in the case of stuck tooling. Without a reliable cable release system, the drill string can only be retracted by cutting the drilling cable with a grinder as every rod is removed, which is a very time-consuming and laborious process. Moreover, it is contemplated that the disclosed system can overcome the deficiencies of previous shear pin solutions, which have been unreliable in that they are typically too ductile (e.g., by deforming with use and not shearing cleanly when needed).

In exemplary aspects, it is contemplated that the disclosed cable release system can be used in underground drilling applications. However, in other exemplary aspects, it is contemplated that the disclosed cable release system can be used in surface drilling applications, including for example and without limitation, surface drilling using declined or down-angled, vertical, or near-vertical holes drilled from a surface or near-surface location. In these aspects, it is contemplated that the use of a pump-in cable release sleeve can provide substantial improvements and advantages in comparison to existing or conventional gravity-driven drop sleeves, which typically require cutting of drilling cable.

The Slotted Loading Chamber

Figure 5A:
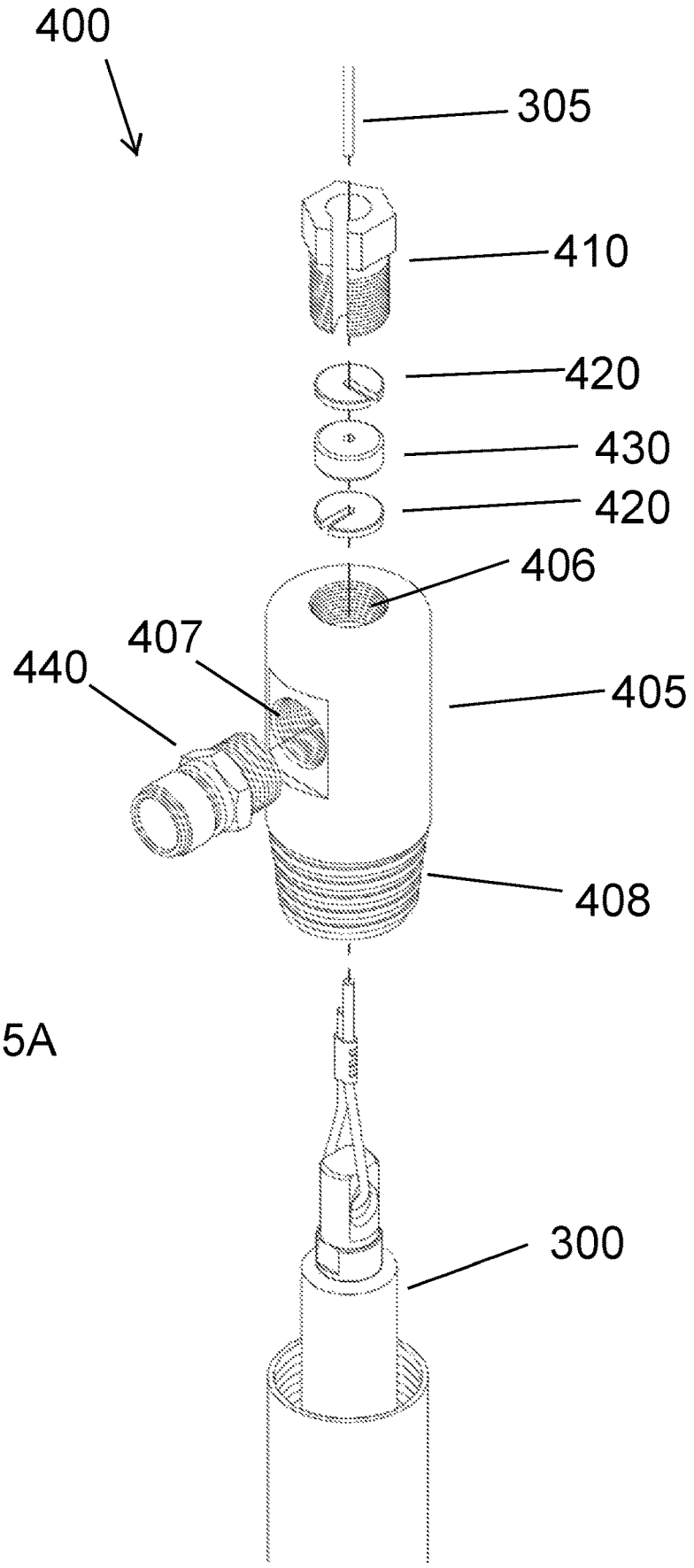
FIGS. 5A-5B are perspective views of an exemplary loading chamber assembly as disclosed herein.
Figure 5B:
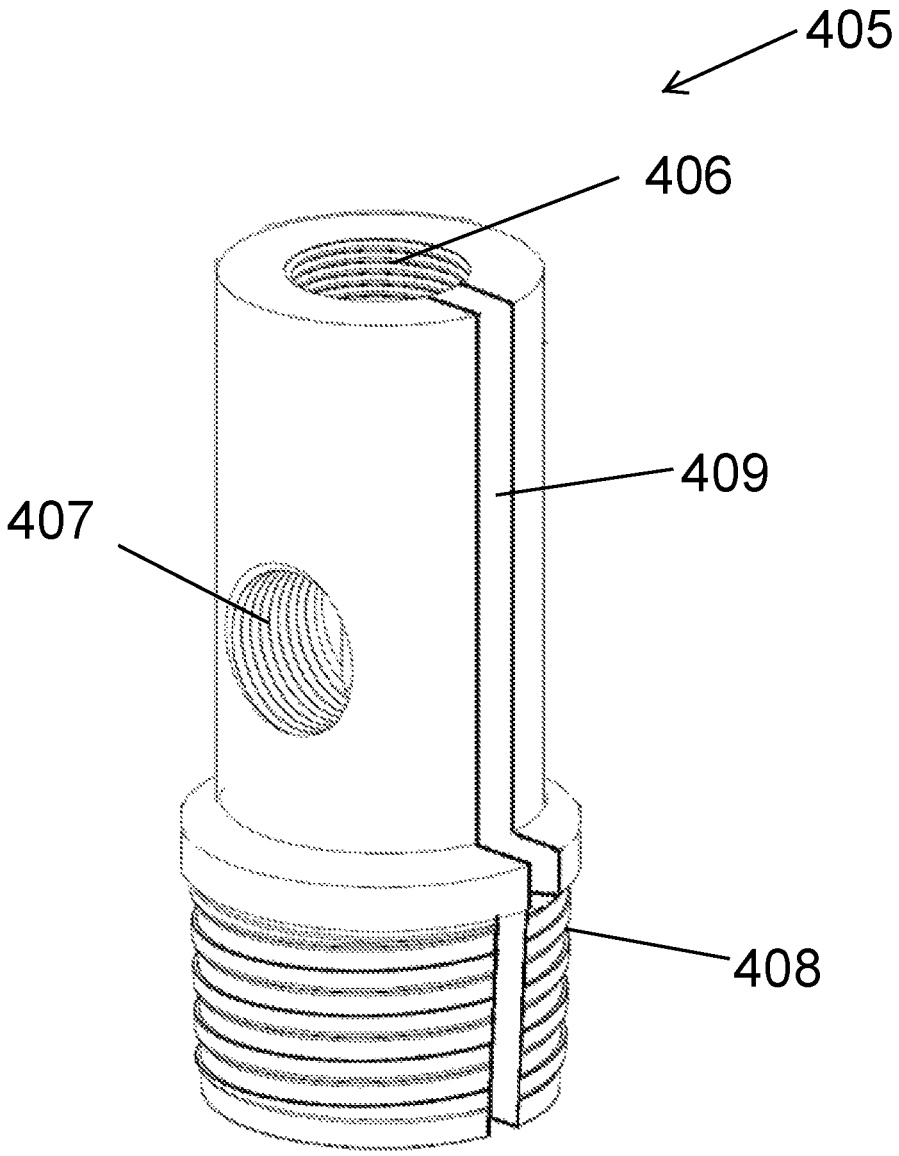

In exemplary surface drilling applications, and with reference to FIGS. 5A-5B, it is contemplated that a loading chamber assembly 400 can be used in conjunction with the disclosed overshot system 300. In use, it is contemplated that the loading chamber assembly 400 can be configured to form a seal around a drilling cable and receive and deliver pressurized fluid to pump the overshot system 300 into a drill string in the manner known in the art. In exemplary non-limiting aspects, the loading chamber assembly 400 can comprise a loading chamber body 405 having a central bore 406, a radially extending inlet port 407, and a threaded distal end 408. In these aspects, it is contemplated that the threaded distal end 408 of the loading chamber assembly 400 can be threadedly connectable to a proximal, box end of the drill string. In another aspect, the loading chamber assembly 400 can further comprise an inlet coupler 440 that is configured to for engagement (e.g., threaded engagement) with the inlet port 407 of the loading chamber body 405. In this aspect, the inlet coupler 440 can receive pressurized fluid and deliver the pressurized fluid to the central bore 406 of the loading chamber body 405. In a further aspect, the loading chamber assembly 400 can comprise cable packing 430 that forms a seal around the drilling cable 305 in the conventional manner. Optionally, in this aspect, the loading chamber assembly 400 can comprise a pair of guide washers 420 that are positioned on opposing sides of the cable packing within the central bore 406 of the loading chamber body. In a further aspect, the loading chamber assembly 400 can further comprise a packing plug 410 that is configured for threaded engagement with an inner surface of the loading chamber body 405 that defines the central bore 406. As depicted in FIG. 5A, it is contemplated that the packing plug 410 and the guide washers can have axial slots that permit positioning of the packing plug and the guide washers over or away from the drilling cable 305. Optionally, it is contemplated that the guide washers and the cable packing can be manually cut to permit assembly over or around the drilling cable 305. Conventionally, as shown in FIG. 5A, the loading chamber body 405 can completely circumferentially enclose the central bore 406. However, in exemplary aspects, and as depicted in FIG. 5B, it is contemplated that the loading chamber body 405 can define an axial slot 409 extending along the entire axial length of the loading chamber body. Optionally, the axial slot can be parallel or substantially parallel to the drilling axis; alternatively, it is contemplated that the axial slot can be angled to help maintain the drilling cable within the central bore of the loading chamber body. In use, it is contemplated that the drilling cable can be passed through the axial slot to permit removal of the loading chamber body from the drilling cable 305 without the need for cutting the cable. Thus, with the slotted loading chamber body, it is possible to: (a) assemble the loading chamber assembly onto and around the drilling cable; and (b) disassemble and remove the loading chamber assembly without the need for cutting of the cable or removal of the overshot system 300.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A cable release system comprising: a swivel body configured for coupling to a drilling cable and having a distal end portion, the distal end portion having an outer surface and defining at least one groove that is radially recessed relative to the outer surface; a bearing assembly having: a receptacle body having a wall with an outer surface, the wall having a proximal portion that has an inner surface that defines an interior cavity configured to receive at least a portion of the distal end portion of the swivel body; and an outer sleeve having a wall at least partially circumferentially surrounding the wall of the receptacle body, the wall of the outer sleeve having an inner surface that is radially spaced from the outer surface of the wall of the receptacle body; a plurality of locking elements positioned in engagement with the inner surface of the outer sleeve; and a release sleeve assembly that is axially moveable relative to a drilling axis, wherein, upon movement of the release sleeve assembly in a distal direction relative to the drilling axis, the release sleeve assembly is configured to engage the outer sleeve of the bearing assembly to effect distal movement of the outer sleeve relative to the drilling axis from a first axial position to a second axial position, and wherein distal movement of the outer sleeve of the bearing assembly from the first axial position to the second axial position effects radial movement of the plurality of locking elements from a retracted position in which the locking elements are received within the at least one groove of the distal end portion of the swivel body to an extended position in which the locking elements are disengaged from the outer surface of the distal end portion of the swivel body.

Aspect 2. The cable release system of aspect 1, wherein the wall of the receptacle body defines a plurality of radial openings extending from the inner surface to the outer surface of the proximal portion of the receptacle body, wherein each respective radial opening of the receptacle body is configured to receive a portion of a corresponding locking element and permit radial movement of the locking element about and between the retracted position and the extended position.

Aspect 3: The cable release system of aspect 2, wherein the inner surface of the wall of the outer sleeve has a first portion having a first radial thickness and a second portion having a second radial thickness less than the first radial thickness, wherein, in the first axial position, the second portion of the inner surface of the outer sleeve drives the locking elements to the retracted position, and wherein, as the outer sleeve moves from the first axial position to the second axial position, the plurality of locking elements move into the extended position and are disengaged from the outer surface of the distal end portion of the swivel body.

Aspect 4: The cable release system of aspect 2 or aspect 3, wherein the interior cavity of the receptacle body has a base surface that is configured for engagement with the distal end portion of the swivel body.

Aspect 5: The cable release system of aspect 4, wherein the receptacle body has a distal portion that extends axially away from the base surface of the interior cavity.

Aspect 6: The cable release system of aspect 5, further comprising a biasing element configured to axially bias the outer sleeve in a proximal direction.

Aspect 7: The cable release system of aspect 6, wherein the biasing element comprises: a distal body that at least partially circumferentially surrounds the distal portion of the receptacle body and is positioned in engagement with the distal portion of the receptacle body, wherein the distal body has an interior surface that defines a seat; and a spring positioned between and in engagement with the seat of the distal body and a portion of the outer sleeve.

Aspect 8: The cable release system of aspect 7, wherein the spring circumferentially surrounds at least a portion of the proximal portion of the receptacle body.

Aspect 9: The cable release system of aspect 8, wherein the distal body has a proximal end portion that defines an interior cavity that receives at least a portion of the spring and at least a portion of the proximal end portion of the receptacle body, and wherein the outer sleeve at least partially circumferentially surrounds at least a portion of the proximal end portion of the distal body.

Aspect 10: The cable release system of aspect 8 or aspect 9, wherein at least a portion of the distal portion of the receptacle body is threaded, and wherein the interior surface of the distal body has a threaded portion that is configured for threaded engagement with the threaded portion of the distal portion of the receptacle body.

Aspect 11: The cable release system of any one of aspects 8-10, wherein the proximal portion of the receptacle body defines a shoulder surface that extends radially outwardly from the distal portion of the receptacle body, and wherein the seat of the distal body is configured to abut the shoulder surface of the proximal portion of the receptacle body.

Aspect 12: The cable release system of any one of the preceding claims, wherein the release sleeve assembly comprises: a thimble body having a proximal end portion, an opposed distal end portion, and a central bore extending through the proximal and distal end portions, the distal end portion defining a groove, wherein the central bore of the thimble body is configured to receive a portion of a drilling cable; a release sleeve having a proximal end, an opposed distal end, and a wall extending between the proximal and distal ends, the wall of the release sleeve defining a central bore of the release sleeve and an axial slit and a side opening positioned in communication with the central bore of the release sleeve, the axial slit extending from the distal end of the release sleeve to the side opening, the side opening extending from the axial slit to the proximal end of the release sleeve, wherein the axial slit and the side opening of the release sleeve are configured to receive a portion of a cable, wherein the side opening of the release sleeve is configured to receive a portion of the distal end portion of the thimble body, wherein at least a portion of the wall of the release sleeve that defines the side opening is configured for complementary engagement with the groove of the distal end portion of the thimble body, and wherein the axial slit and side opening of the release sleeve are configured to permit engagement between the release sleeve and the distal end portion of the thimble body after a cable is positioned through the central bore of the thimble body.

Aspect 13: The cable release system of aspect 12, wherein the thimble body and the release sleeve are held together without fasteners or threads.

Aspect 14: The cable release system of aspect 12 or aspect 13, wherein the proximal end portion of the thimble body defines a proximal flange.

Aspect 15: The cable release system of aspect 14, further comprising a first seal element defining a central bore, the first seal element being configured for positioning between the proximal end of the release sleeve and the proximal flange of the thimble body such that the central bore of the first seal element receives a portion of the thimble body.

Aspect 16: The cable release system of aspect 15, wherein the first seal element is a lip seal.

Aspect 17: The cable release system of aspect 15 or aspect 16, further comprising a second seal element defining a central bore, the second seal element being configured for positioning distal to the distal end portion of the thimble body such that the second seal element is positioned within the central bore of the release sleeve, wherein the second seal element is configured to form a seal with a cable positioned within the central bore of the release sleeve.

Aspect 18: A cable release assembly comprising: a swivel body configured for coupling to a drilling cable and having a distal end portion, the distal end portion having an outer surface and defining at least one groove that is radially recessed relative to the outer surface; a bearing subassembly having: a receptacle body having a wall with an outer surface, the wall having a proximal portion that defines an interior cavity configured to receive at least a portion of the distal end portion of the swivel body; and an outer sleeve having a wall at least partially circumferentially surrounding the wall of the receptacle body, the wall of the outer sleeve having an inner surface that is radially spaced from the outer surface of the wall of the receptacle body; and a plurality of locking elements positioned in engagement with the inner surface of the outer sleeve, wherein distal movement of the outer sleeve of the bearing subassembly from a first axial position to a second axial position effects radial movement of the plurality of locking elements from a retracted position in which the locking elements are received within the at least one groove of the distal end portion of the swivel body to an extended position in which the locking elements are disengaged from the outer surface of the distal end portion of the swivel body.

Aspect 19: The cable release assembly of aspect 18, wherein the wall of the receptacle body defines a plurality of radial openings extending from the inner surface to the outer surface of the receptacle body, wherein each respective radial opening of the receptacle body is configured to receive a portion of a corresponding locking element and permit radial movement of the locking element about and between the retracted position and the extended position.

Aspect 20: The cable release assembly of aspect 19, wherein the inner surface of the wall of the outer sleeve has a first portion having a first radial thickness and a second portion having a second radial thickness less than the first radial thickness, wherein, in the first axial position, the second portion of the inner surface of the outer sleeve drives the locking elements to the retracted position, and wherein, as the outer sleeve moves from the first axial position to the second axial position, the plurality of locking elements move into the extended position and are disengaged from the outer surface of the distal end portion of the swivel body.

Aspect 21: The cable release assembly of aspect 19 or aspect 20, wherein the interior cavity of the receptacle body has a base surface that is configured for engagement with the distal end portion of the swivel body.

Aspect 22: The cable release assembly of aspect 21, wherein the receptacle body has a distal portion that extends axially away from the base surface of the interior cavity.

Aspect 23: The cable release assembly of aspect 22, further comprising a biasing element configured to axially bias the outer sleeve in a proximal direction.

Aspect 24: The cable release assembly of aspect 23, wherein the biasing element comprises: a distal body that at least partially circumferentially surrounds the distal portion of the receptacle body and is positioned in engagement with the distal portion of the receptacle body, wherein the distal body has an interior surface that defines a seat; and a spring positioned between and in engagement with the seat of the distal body and a portion of the outer sleeve.

Aspect 25: The cable release assembly of aspect 24, wherein the spring circumferentially surrounds at least a portion of the proximal portion of the receptacle body.

Aspect 26: The cable release assembly of aspect 25, wherein the distal body has a proximal end portion that defines an interior cavity that receives at least a portion of the spring and at least a portion of the proximal end portion of the receptacle body, and wherein the outer sleeve at least partially circumferentially surrounds at least a portion of the proximal end portion of the distal body.

Aspect 27: The cable release assembly of aspect 25 or aspect 26, wherein at least a portion of the distal portion of the receptacle body is threaded, and wherein the interior surface of the distal body has a threaded portion that is configured for threaded engagement with the threaded portion of the distal portion of the receptacle body.

Aspect 28: The cable release assembly of any one of aspects 25-27, wherein the proximal portion of the receptacle body defines a shoulder surface that extends radially outwardly from the distal portion of the receptacle body, and wherein the seat of the distal body is configured to abut the shoulder surface of the proximal portion of the receptacle body.

Aspect 29: A release sleeve assembly comprising: a thimble body having a proximal end portion, an opposed distal end portion, and a central bore extending through the proximal and distal end portions, the distal end portion defining a groove, wherein the central bore of the thimble body is configured to receive a portion of a drilling cable; a release sleeve having a proximal end, an opposed distal end, and a wall extending between the proximal and distal ends, the wall of the release sleeve defining a central bore of the release sleeve and an axial slit and a side opening positioned in communication with the central bore of the release sleeve, the axial slit extending from the distal end of the release sleeve to the side opening, the side opening extending from the axial slit to the proximal end of the release sleeve, wherein the axial slit and the side opening of the release sleeve are configured to receive a portion of a cable, wherein the side opening of the release sleeve is configured to receive a portion of the distal end portion of the thimble body, wherein at least a portion of the wall of the release sleeve that defines the side opening is configured for complementary engagement with the groove of the distal end portion of the thimble body, and wherein the axial slit and side opening of the release sleeve are configured to permit engagement between the release sleeve and the distal end portion of the thimble body after a cable is positioned through the central bore of the thimble body.

Aspect 30: The release sleeve assembly of aspect 29, wherein the thimble body and the release sleeve are held together without fasteners or threads.

Aspect 31: The release sleeve assembly of aspect 29 or aspect 30, wherein the proximal end portion of the thimble body defines a proximal flange.

Aspect 32: The release sleeve assembly of aspect 31, further comprising a first seal element defining a central bore, the first seal element being configured for positioning between the proximal end of the release sleeve and the proximal flange of the thimble body such that the central bore of the first seal element receives a portion of the thimble body.

Aspect 33: The release sleeve assembly of aspect 32, wherein the first seal element is a lip seal.

Aspect 34: The release sleeve assembly of aspect 32, further comprising a second seal element defining a central bore, the second seal element being configured for positioning distal to the distal end portion of the thimble body such that the second seal element is positioned within the central bore of the release sleeve, wherein the second seal element is configured to form a seal with a cable positioned within the central bore of the release sleeve.

Aspect 35: A method of using the cable release system of one of aspects 1-17.

Aspect 36: A method of using the cable release assembly of one of aspects 18-28.

Aspect 37: A method of using the release sleeve assembly of one of aspects 29-34.

Aspect 38: An overshot system comprising: a cable release assembly of any one of aspects 18-28; and an overshot head assembly secured to a distal portion of the cable release assembly.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A cable release system comprising:

a swivel body configured for coupling to a drilling cable and having a distal end portion, the distal end portion having an outer surface and defining at least one groove that is radially recessed relative to the outer surface;

a bearing assembly having:

a receptacle body having a wall with an outer surface, the wall having a proximal portion that has an inner surface that defines an interior cavity configured to receive at least a portion of the distal end portion of the swivel body; and an outer sleeve having a wall at least partially circumferentially surrounding the wall of the receptacle body, the wall of the outer sleeve having an inner surface that is radially spaced from the outer surface of the wall of the receptacle body;

a plurality of locking elements positioned in engagement with the inner surface of the outer sleeve; and a release sleeve assembly that is axially moveable relative to a drilling axis, wherein, upon movement of the release sleeve assembly in a distal direction relative to the drilling axis, the release sleeve assembly is configured to engage the outer sleeve of the bearing assembly to effect distal movement of the outer sleeve relative to the drilling axis from a first axial position to a second axial position, and wherein distal movement of the outer sleeve of the bearing assembly from the first axial position to the second axial position effects radial movement of the plurality of locking elements from a retracted position in which the locking elements are received within the at least one groove of the distal end portion of the swivel body to an extended position in which the locking elements are disengaged from the outer surface of the distal end portion of the swivel body.

2. The cable release system of claim 1, wherein the inner surface of the wall of the outer sleeve has a first portion having a first radial thickness and a second portion having a second radial thickness less than the first radial thickness, wherein, in the first axial position, the second portion of the inner surface of the outer sleeve drives the locking elements to the retracted position, and wherein, as the outer sleeve moves from the first axial position to the second axial position, the plurality of locking elements move into the extended position and are disengaged from the outer surface of the distal end portion of the swivel body.

3. The cable release system of claim 1, wherein the interior cavity of the receptacle body has a base surface that is configured for engagement with the distal end portion of the swivel body.

4. The cable release system of claim 3, wherein the receptacle body has a distal portion that extends axially away from the base surface of the interior cavity, and wherein the cable release system further comprises a biasing element configured to axially bias the outer sleeve in a proximal direction.

5. The cable release system of claim 4, wherein the biasing element comprises:

a distal body that at least partially circumferentially surrounds the distal portion of the receptacle body and is positioned in engagement with the distal portion of the receptacle body, wherein the distal body has an interior surface that defines a seat; and a spring positioned between and in engagement with the seat of the distal body and a portion of the outer sleeve.

6. The cable release system of claim 5, wherein the spring circumferentially surrounds at least a portion of the proximal portion of the receptacle body.

7. The cable release system of claim 6, wherein the distal body has a proximal end portion that defines an interior cavity that receives at least a portion of the spring and at least a portion of the proximal end portion of the receptacle body, and wherein the outer sleeve at least partially circumferentially surrounds at least a portion of the proximal end portion of the distal body.

8. The cable release system of claim 6, wherein at least a portion of the distal portion of the receptacle body is threaded, and wherein the interior surface of the distal body has a threaded portion that is configured for threaded engagement with the threaded portion of the distal portion of the receptacle body.

9. The cable release system of claim 6, wherein the proximal portion of the receptacle body defines a shoulder surface that extends radially outwardly from the distal portion of the receptacle body, and wherein the seat of the distal body is configured to abut the shoulder surface of the proximal portion of the receptacle body.

10. The cable release system of claim 1, wherein the release sleeve assembly comprises:

a thimble body having a proximal end portion, an opposed distal end portion, and a central bore extending through the proximal and distal end portions, the distal end portion defining a groove, wherein the central bore of the thimble body is configured to receive a portion of a drilling cable;

a release sleeve having a proximal end, an opposed distal end, and a wall extending between the proximal and distal ends, the wall of the release sleeve defining a central bore of the release sleeve and an axial slit and a side opening positioned in communication with the central bore of the release sleeve, the axial slit extending from the distal end of the release sleeve to the side opening, the side opening extending from the axial slit to the proximal end of the release sleeve, wherein the axial slit and the side opening of the release sleeve are configured to receive a portion of a cable, wherein the side opening of the release sleeve is configured to receive a portion of the distal end portion of the thimble body, wherein at least a portion of the wall of the release sleeve that defines the side opening is configured for complementary engagement with the groove of the distal end portion of the thimble body, and wherein the axial slit and side opening of the release sleeve are configured to permit engagement between the release sleeve and the distal end portion of the thimble body after a cable is positioned through the central bore of the thimble body.

11. The cable release system of claim 10, wherein the thimble body and the release sleeve are held together without fasteners or threads.

12. A cable release assembly comprising:

a swivel body configured for coupling to a drilling cable and having a distal end portion, the distal end portion having an outer surface and defining at least one groove that is radially recessed relative to the outer surface;

a bearing subassembly having:

a receptacle body having a wall with an outer surface, the wall having a proximal portion that defines an interior cavity configured to receive at least a portion of the distal end portion of the swivel body; and an outer sleeve having a wall at least partially circumferentially surrounding the wall of the receptacle body, the wall of the outer sleeve having an inner surface that is radially spaced from the outer surface of the wall of the receptacle body; and a plurality of locking elements positioned in engagement with the inner surface of the outer sleeve, wherein distal movement of the outer sleeve of the bearing subassembly from a first axial position to a second axial position effects radial movement of the plurality of locking elements from a retracted position in which the locking elements are received within the at least one groove of the distal end portion of the swivel body to an extended position in which the locking elements are disengaged from the outer surface of the distal end portion of the swivel body.

13. The cable release assembly of claim 12, wherein the inner surface of the wall of the outer sleeve has a first portion having a first radial thickness and a second portion having a second radial thickness less than the first radial thickness, wherein, in the first axial position, the second portion of the inner surface of the outer sleeve drives the locking elements to the retracted position, and wherein, as the outer sleeve moves from the first axial position to the second axial position, the plurality of locking elements move into the extended position and are disengaged from the outer surface of the distal end portion of the swivel body.

14. The cable release assembly of claim 12, wherein the interior cavity of the receptacle body has a base surface that is configured for engagement with the distal end portion of the swivel body.

15. The cable release assembly of claim 14, wherein the receptacle body has a distal portion that extends axially away from the base surface of the interior cavity, and wherein the cable release assembly further comprises a biasing element configured to axially bias the outer sleeve in a proximal direction.

16. The cable release assembly of claim 15, wherein the biasing element comprises:

a distal body that at least partially circumferentially surrounds the distal portion of the receptacle body and is positioned in engagement with the distal portion of the receptacle body, wherein the distal body has an interior surface that defines a seat; and a spring positioned between and in engagement with the seat of the distal body and a portion of the outer sleeve.

17. The cable release assembly of claim 16, wherein the spring circumferentially surrounds at least a portion of the proximal portion of the receptacle body.

18. The cable release assembly of claim 17, wherein the distal body has a proximal end portion that defines an interior cavity that receives at least a portion of the spring and at least a portion of the proximal end portion of the receptacle body, and wherein the outer sleeve at least partially circumferentially surrounds at least a portion of the proximal end portion of the distal body.

19. The cable release assembly of claim 17, wherein at least a portion of the distal portion of the receptacle body is threaded, and wherein the interior surface of the distal body has a threaded portion that is configured for threaded engagement with the threaded portion of the distal portion of the receptacle body.

20. The cable release assembly of claim 17, wherein the proximal portion of the receptacle body defines a shoulder surface that extends radially outwardly from the distal portion of the receptacle body, and wherein the seat of the distal body is configured to abut the shoulder surface of the proximal portion of the receptacle body.

* * * * *